US007882706B2

(12) United States Patent
Thali et al.

(10) Patent No.: US 7,882,706 B2
(45) Date of Patent: Feb. 8, 2011

(54) BEVERAGE COOLING SYSTEM

(75) Inventors: Rohit Ravindran Thali, Bristol, PA (US); Shawn J. Booth, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 427 days.

(21) Appl. No.: 12/100,800

(22) Filed: Apr. 10, 2008

(65) Prior Publication Data

US 2009/0255293 A1 Oct. 15, 2009

(51) Int. Cl.
*F25C 5/06* (2006.01)

(52) U.S. Cl. ..... 62/72; 62/347; 62/356; 249/119

(58) Field of Classification Search ..... 62/66–74, 62/340–356, 457.3–457.5; 249/63–64, 119–123, 249/176, 117, 142–144
See application file for complete search history.

(56) References Cited

U.S. PATENT DOCUMENTS

| | | | | |
|---|---|---|---|---|
| 1,881,817 | A | | 10/1932 | Meyer |
| 2,146,236 | A | | 2/1939 | Stamp |
| 3,605,435 | A | | 9/1971 | Taylor |
| D270,985 | S | | 10/1983 | Hill |
| 4,438,637 | A | | 3/1984 | Atkinson |
| 4,546,900 | A | * | 10/1985 | Lackey ..... 220/592.16 |
| 4,550,575 | A | * | 11/1985 | DeGaynor ..... 62/308 |
| 4,625,518 | A | | 12/1986 | Freedman |
| 4,899,553 | A | | 2/1990 | Drummond, III |
| 4,910,976 | A | | 3/1990 | Drummond, III |
| 5,148,682 | A | | 9/1992 | Wolf |
| 5,250,315 | A | * | 10/1993 | Loew et al. ..... 426/524 |
| 5,419,856 | A | * | 5/1995 | Shaw ..... 264/28 |
| 5,651,254 | A | | 7/1997 | Berry |
| 5,884,490 | A | | 3/1999 | Whidden |
| 6,067,813 | A | | 5/2000 | Smith |
| 6,446,461 | B1 | | 9/2002 | Williams, Jr. |
| 6,640,558 | B1 | * | 11/2003 | Zenisek ..... 62/66 |
| 7,240,514 | B2 | | 7/2007 | Gary |
| 7,272,935 | B1 | | 9/2007 | Wolf et al. |
| 2007/0186580 | A1 | | 8/2007 | Kaplan |
| 2007/0289316 | A1 | | 12/2007 | Bonjack et al. |

* cited by examiner

*Primary Examiner*—William E Tapolcai
(74) *Attorney, Agent, or Firm*—Quarles & Brady LLP

(57) ABSTRACT

The present invention provides an easy and convenient way of cooling or chilling beverage containers. An ice mold is filled with water. The water is froze in the ice mold to form a block of ice having at least one beverage recess formed therein. The block of ice is removed from the ice mold and placed in the basin of the sink such that the block of ice is closely supported by the basin of the sink and beverage containers can be received in the beverage recesses in the block of ice.

16 Claims, 4 Drawing Sheets

FIG. 1
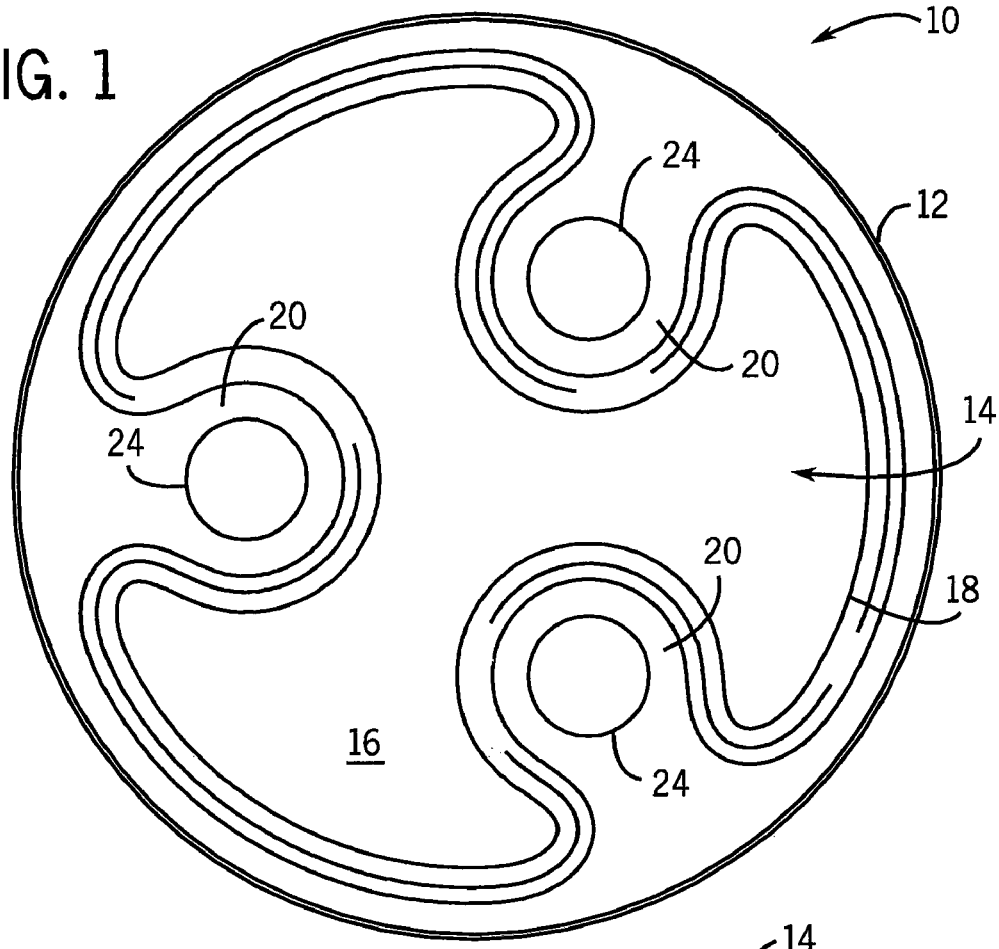
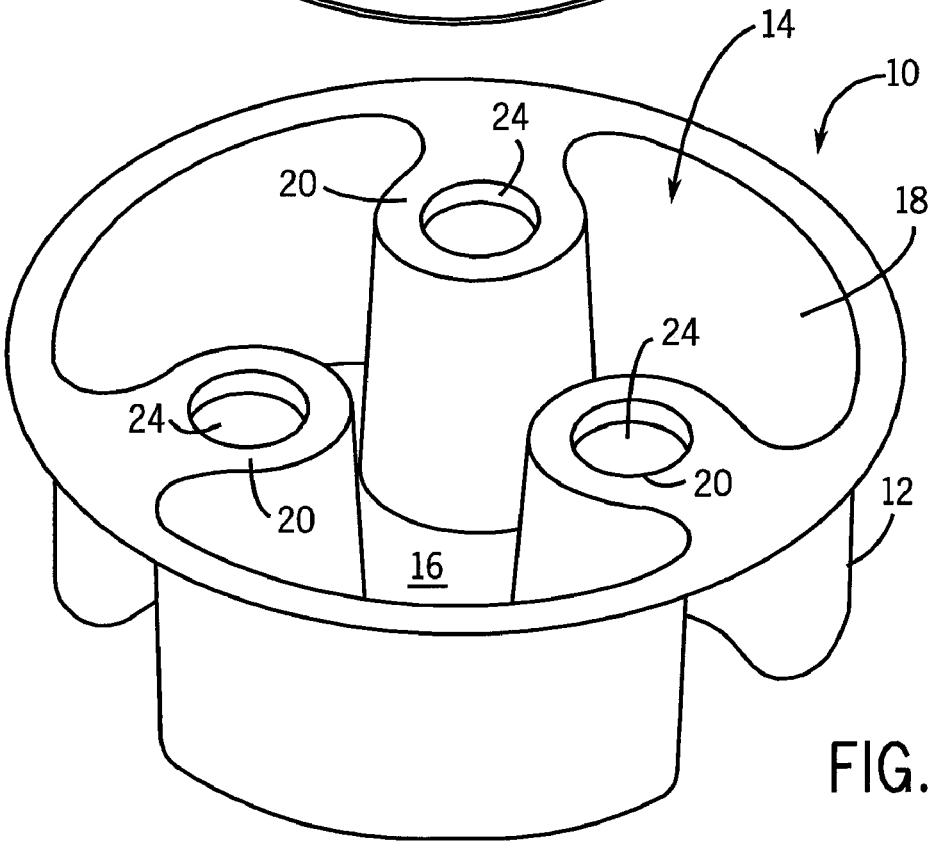
FIG. 2

FIG. 3
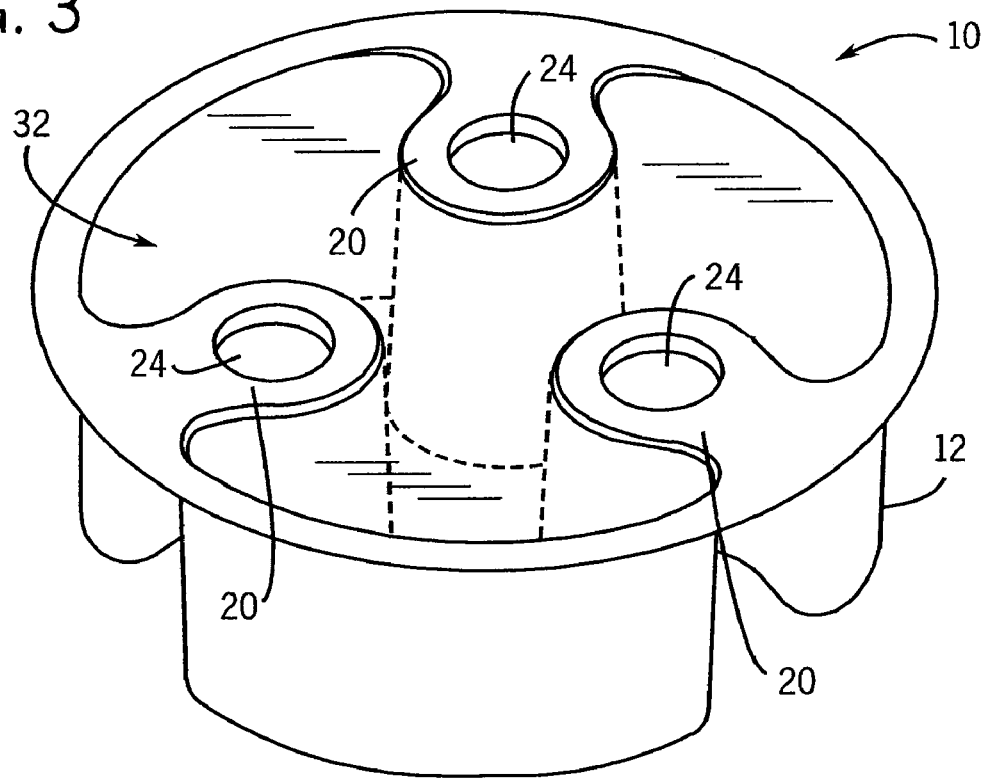
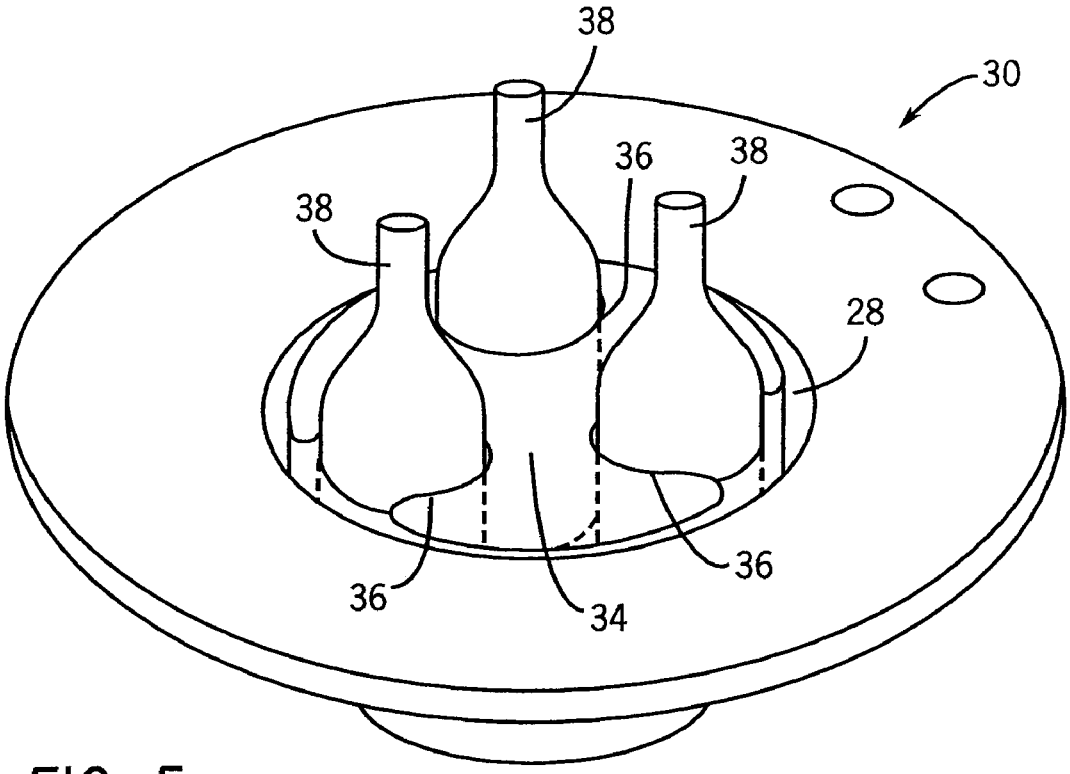
FIG. 5

BEVERAGE COOLING SYSTEM

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention relates to the cooling of beverages. In particular, this invention relates to the cooling of beverage containers using ice.

It is often desirable to cool beverages prior to consumption. Commonly, beverages are cooled or chilled by refrigerating the container holding the beverage. Although electric refrigerators are found in the kitchens of most homes, when entertaining it may be more convenient to have a means of chilling beverages at the location of the guests. Often this location is a recreation room or another room away from the kitchen.

Portable chest coolers can be filled with ice cubes to chill beverages. However, it can be difficult to properly distribute the beverage containers within the ice. Even if the beverage containers are evenly distributed throughout the ice, taking a container out of a chest cooler often means having to dig though a mixture of ice and water. Moreover, after use, the leftover ice and water must be emptied from the chest cooler. With the potential for leaks, coolers are not always an ideal means of chilling beverages. Additionally, the failure to sufficiently dry the interior of the chest cooler may result in the formation of molds or other mildew that carry an unpleasant odor.

Other cooling devices have been developed, but are not always practical for entertaining. See e.g., U.S. Pat. Nos. 3,605,435; D270,985; 4,438,637; 4,625,518; 6,446,461; 7,240,514. Some cooling devices require moveable parts that may prevent easy access to the beverages. Other cooling devices, although portable, are more suited for cooling of beverages for travel than for entertaining. Yet others, such as the cooling devices shown in U.S. Pat. No. 4,899,553, present many of the same issues with disposal of the water.

Hence, a need still exists for improved means of cooling beverages that provides easy access to the beverages without the aforementioned problems of most available coolers.

SUMMARY OF THE INVENTION

The present invention provides an easy and convenient way of cooling beverage containers, such as, for example, wine bottles. The invention includes using a sink to closely support a molded block of ice that receives the beverage containers. As the block of ice melts, the melted water is drained via the sink.

According to one aspect of the invention, a beverage cooling kit comprises a sink and an ice mold. The sink has a basin with a drain. The ice mold has mold walls with at least one projection extending therefrom. The mold walls define a volume for the freezing of water into a block of ice. The resulting block of ice has at least one beverage recess formed therein by the at least one projection of the mold walls. When the block of ice formed by the ice mold is received in the basin of the sink, the at least one beverage recess in the block of ice is configured to support at least one beverage container.

At least a portion of a surface of the basin and at least a portion of the mold walls may have a corresponding profile such that the block of ice formed by the ice mold is closely supported by the at least a portion of the surface of the basin. At least one beverage may be placed in the at least one beverage recess in the block of ice.

The ice mold may be a flexible ice mold. At least one release hole may be formed in the flexible ice mold to assist in deforming the flexible ice mold when removing the block of ice formed therein.

According to another aspect of the invention, a beverage cooling system comprises a sink and a block of ice. The sink has a basin with a drain. The block of ice has at least one beverage recess formed therein for supporting at least one beverage container. The block of ice is located in and supported by the basin of the sink. At least a portion of a surface of the basin and at least a portion of a surface of the block of ice have a corresponding profile such that, when the block of ice is received by the basin, the block of ice is closely supported by the basin.

Each of the at least one beverage recesses may have a corresponding axis along a direction of beverage container insertion such that each of the corresponding axis are parallel to one another.

Beverage containers may be located in the beverage recesses in the block of ice. The beverage recesses may be vertically oriented such that the beverage containers supported therein are vertically oriented. The basin of the sink may have a flat bottom such that, as the block of ice melts, the beverage containers remain standing in an essentially vertically direction. Moreover, the block of ice may be formed using a flexible ice mold.

According to yet another aspect of the invention, a method of cooling a beverage using a beverage cooling kit is provided. A sink having a basin with a drain, an ice mold, water, and at least one beverage container are provided. The ice mold is filled with the water. The water is froze in the ice mold to form a block of ice having at least one beverage recess therein. The block of ice is removed from the ice mold. The block of ice is placed in the basin of the sink such that the at least one beverage container can be received in the beverage recess in the block of ice. The block of ice may be closely supported by the basin of the sink. Additionally, at least one beverage container may be placed in the beverage recess in the block of ice.

Thus, the present invention provides an easy and convenient way of chilling beverages. Unlike many means of cooling, such as chest coolers, it is not necessary to dispose of melted ice water since any melted water immediately is disposed of via the drain in the sink. Moreover, the beverage containers contained in the block of ice in the sink can be easily accessible and remain in an upright position, even as the block of ice melts away.

These and still other advantages of the invention will be apparent from the detailed description and drawings. What follows is merely a description of preferred embodiments of the present invention. To assess the full scope of the invention the claims should be looked to as the preferred embodiments are not intended to be the only embodiments within the scope of the claims.

BRIEF DESCRIPTION OF THE DRAWINGS

FIG. 1 is a top plan view of an ice mold in accordance with one embodiment of the present invention;

FIG. 2 is a perspective view of the ice mold;

FIG. 3 is a perspective view of the ice mold filled with water;

FIG. 5 is a perspective view of the block of ice with three wine bottles placed in a sink supporting the block of ice.

DETAILED DESCRIPTION OF THE PREFERRED EMBODIMENTS

Figure 4:
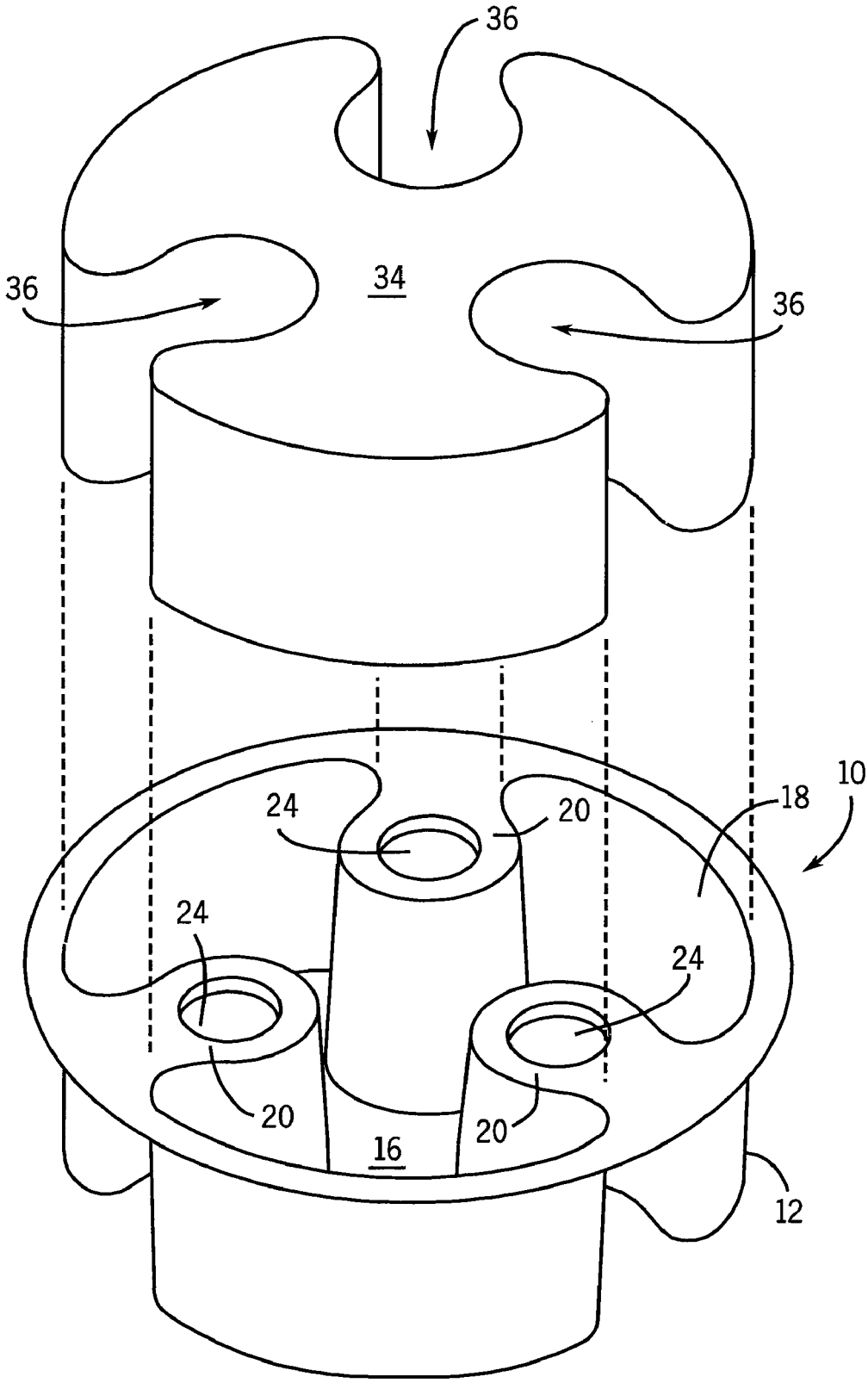
FIG. 4 is a perspective view of a block of ice being extracted from the ice mold.

Referring now to FIGS. 1 and 2, an ice mold 10 is shown. The ice mold 10 has walls 12 defining a volume 14. The ice mold 10 has a base 16, side walls 18 with three projections 20 extending therefrom, an upper flange 22, and holes 24. The volume 14 has a shape that corresponds to the shape of a basin 28 in a sink 30 as shown in FIG. 5

Referring now to FIG. 3, the volume 14 of the ice mold 10 holds water 32. The water 32 is contained in the volume 14 by the walls 12. The ice mold 10 filled with water 32 can then be cooled to a temperature below the freezing point of water. At this temperature, the water 32 solidifies into ice.

Referring now to FIG. 4, a block of ice 34 is removed from the ice mold 10. The shape of the block of ice 34 is determined by the volume 14 of the ice mold. Beverage recesses 36 are formed into the block of ice 34 by the projections 20 on the walls 12 of the ice mold 10. The beverage recesses 36 are generally cylindrically shaped and extend in a vertical direction through the block of ice 34. Moreover, each of the beverage recesses 36 may each have an axis defined by the direction of beverage insertion. These axes may be parallel to one another such that the beverage containers inserted into the beverage recesses 36 are all parallel with one another.

Figure 6:
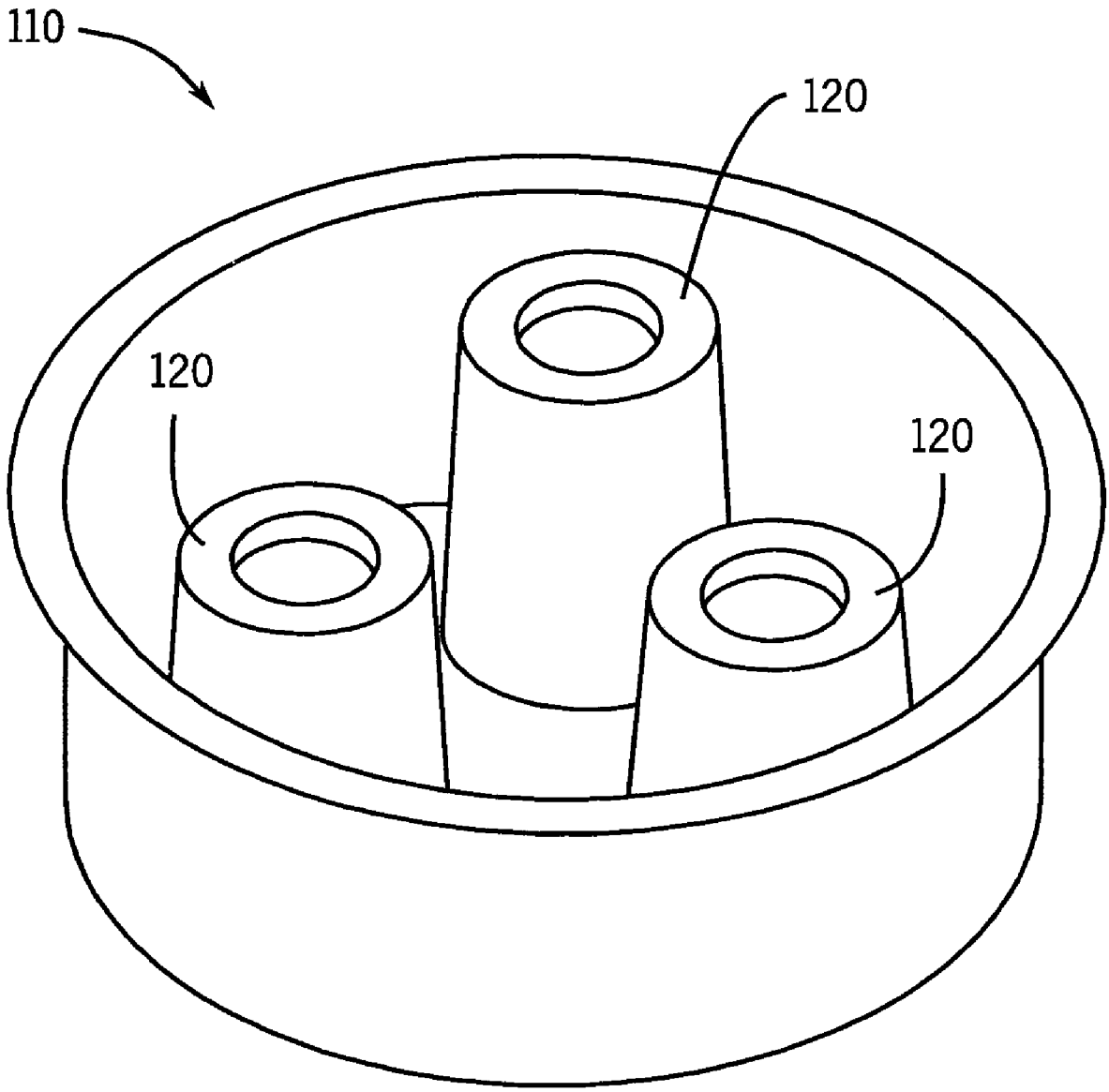
FIG. 6 is a perspective view of an alternative ice mold.

As shown, the beverage recesses 36 extend inward from the outer periphery of the block of ice 34. However, it is also contemplated that the beverage recesses 36 can be formed as through-holes extending through the bulk of the block of ice 34. Such a shape might be formed using the ice mold that is shown in FIG. 6.

The process of removing the block of ice 34 from the ice mold 10 may be promoted by fabricating the ice mold 10 from a flexible elastic material that is easily deformed. The ice mold 10 may be made of materials such as, for example, silicone that are elastically deformable. The holes 24 of the ice mold provide easy to grab apertures on the ice mold 10 that can be used to assist in the separation of the ice mold 10 from the block of ice 34.

Referring now to FIG. 5, the block of ice 34 has been placed in the basin 28 of the sink 30. The sink 30 has a drain connected to a waste water pipe. As previously stated, the block of ice 34 has a shape that is similar to the basin 28 of the sink 30. Thus, when the block of ice 34 is initially placed in the sink 30, the block of ice is closely supported by the basin 28.

By use of the term "closely supported", it is meant that portions of the surface of the block of ice 34 correspond to portions of the surface of the basin 28 such that, when the block of ice 34 is received in the basin 28, each of the corresponding portions can contact one another to support the block of ice 34 in the basin 28. As initially formed, the block of ice 34 will be slightly smaller than the basin 28, such that the block of ice 34 can be inserted into the basin 28. The block of ice 34 is molded with the intention of being mated into the basin 28 of the sink 30, but not formed so closely that it would require create an interference or press fit between the block of ice 34 and the basin 28.

One or more beverage containers 38 can be placed in the beverage recesses 36. Although three bottles of wine are shown in placed in the block of ice 34 in the sink 30, it is contemplated that other mold shapes may be used to form ice blocks of other geometries that can hold other common beverage containers such as, for example, beer, soda, and the like.

It is contemplated that a single sink may be used with multiple ice molds. For example, a sink may have an ice mold designed to form a block of ice that holds wine bottles as well as another ice mold that is designed to hold soda or beer cans.

In some forms of this invention, it may be desirable for the side walls of the basin 28 and the side walls 18 of the ice mold 10 to be tapered. Tapering one or both sets of side walls can provide a system in which the block of ice 34 formed by the ice mold 10 snuggly wedges into the basin 28 of the sink 30 such that side walls of the block of ice 34 are supported by the side walls of the basin 28. Moreover, in this form, the engagement of the block of ice 34 and the basin 28 may result in forming a gap between the bottom face of the block of ice 34 and the bottom of the basin 28. This gap may assist in clearance of the melted liquid from the sink 30. As the block of ice 34 melts, the taper on the side walls may promote continued support of the block of ice 34 by the basin 28 as it descends further into the basin 28.

Once the beverage containers 38 and block of ice 34 are placed in the sink 30, the block of ice 34 will cool or chill the beverage containers. As time passes at room temperature, the block of ice 34 will slowly melt back into liquid. This liquid will be received by the basin 28 of the sink 30 and directed towards the drain and the connected waste water pipe. Thus, as the block of ice 34 melts the melted water is immediately received by the drain and properly disposed of.

It should be appreciated that although draining of the melted liquid phase could occur contemporaneously with the melting of the ice, that is may be desirable to block the drain such that the melted liquid remains in the basin 28. The presence of water in the basin 28 may promote cooling or chilling due to increased surface contact of the cold melted phase with the beverage containers 38. Then, once chilling is complete, the drain may be opened such that the water can be disposed.

Moreover, as the beverage recesses 36 are vertically oriented when the block of ice 34 is placed in the basin 28, the beverage containers 38 are also vertically oriented and will be able to stand on the floor of the basin 28. If the base of the sink 30 is sufficiently flat, the beverage containers 38 remain standing even after the block of ice 34 has melted away around them.

Referring now to FIG. 6, an alternative ice mold 110 is shown. The projections 120 for forming beverage recesses are located such that the resulting block of ice formed by the alternative ice mold 110 will have beverage recesses not located on the outer periphery of the mold. In this way, the beverage recesses formed in the resulting block of ice will approximate channels. A block of ice having the geometry of the alternative ice mold 110 may be desirable as it may provide more areas of surface contact between the block of ice and the beverage containers placed therein.

The present invention provides an improved way to cooling beverages. Because the block of ice is placed in the sink, as the block of ice melts, the melted water from the block of ice is disposed down the drain. Thus, there is no need to actively dispose the water after it has melted.

Moreover, as the block of ice is a unitary form, the present invention provides a more structure form of cooling over the random placement of beverage containers in a plurality of ice cubes. It is easier for a user to find the beverage that he or she is looking for without resorting to digging through a pile of ice.

Many modifications and variations to this preferred embodiment will be apparent to those skilled in the art, which will be within the spirit and scope of the invention. Therefore, the invention should not be limited to the described embodiment. To ascertain the full scope of the invention, the following claims should be referenced

INDUSTRIAL APPLICABILITY

The invention provides an easy and convenient way of cooling beverage containers using an ice mold to form a block of ice for placement in a sink.

What is claimed is:

1. A beverage cooling system comprising:

a sink having a basin; and an ice mold having mold walls with at least one projection extending therefrom, the mold walls defining a volume for freezing water into a block of ice, the block of ice having at least one beverage recess formed therein by the at least one projection;

wherein, when the block of ice formed by the ice mold is received in the basin of the sink, the at least one beverage recess in the block of ice is configured to support at least one beverage container; and wherein the ice mold is a flexible ice mold and there is at least one release hole formed in the flexible ice mold to assist in deforming the flexible ice mold when removing the block of ice formed therein.

2. The system of claim 1 wherein at least a portion of a surface of the basin and at least a portion of the mold walls have a corresponding profile such that the block of ice formed by the ice mold is closely supported by the at least a portion of the surface of the basin.

3. The system claim 1 further comprising at least one beverage located in the at least one beverage recess in the block of ice.

4. The system of claim 1 wherein each of the at least one beverage recesses has a corresponding axis along a direction of beverage container insertion such that each of the corresponding axes are parallel to one another.

5. The system of claim 1 wherein the at least one beverage recess is vertically oriented such that the at least one beverage container supported therein is vertically oriented.

6. The system of claim 1 wherein the basin of the sink has a flat bottom such that, as the block of ice melts, the at least one beverage container remains standing in an essentially vertically direction.

7. A method of cooling a beverage using a beverage cooling kit comprising:

providing a sink having a basin, an ice mold, water, and at least one beverage container;

wherein the ice mold is a flexible ice mold and there is at least one release hole formed in the flexible ice mold to assist in deforming the flexible ice mold when removing the block of ice formed therein;

filling the ice mold with the water;

freezing the water in the ice mold to form a block of ice having at least one beverage recess therein;

removing the block of ice from the ice mold; and placing the block of ice in the basin of the sink such that the block of ice is closely supported by the basin of the sink and such that at least one beverage container can be received in the beverage recess in the block of ice.

8. The method of claim 7 further comprising: placing at least one beverage container in the beverage recess in the block of ice.

9. The method of claim 8 further comprising retaining at least a portion of a melted liquid phase from the block of ice in at least one of the beverage recess and the basin of the sink to promote cooling or chilling of the at least one beverage container.

10. The method of claim 7 further comprising removing at least a portion of a melted liquid phase from the block of ice from the sink.

11. A beverage cooling system for use with a sink having a basin, the system comprising:

an ice mold having mold walls and at least one projection, the mold walls defining a volume for freezing water into a block of ice, the block of ice having at least one beverage recess formed therein by the at least one projection;

wherein the block of ice formed by the ice mold is configured to be received in the basin of the sink, and the at least one beverage recess in the block of ice is configured to support at least one beverage container; and wherein the ice mold is a flexible ice mold and there is at least one release hole formed in the flexible ice mold to assist in deforming the flexible ice mold when removing the block of ice formed therein.

12. The beverage cooling system of claim 11, wherein, when formed, the at least one beverage recess extends through the block of ice.

13. The beverage cooling system of claim 11, wherein, if the block of ice is placed in the basin, a bottom surface of the block of ice can be spaced a distance from a bottom surface of the basin of the sink, forming a gap that facilitates the removal of melted liquid phase portions of the block of ice from the sink.

14. The beverage cooling system of claim 11, wherein the mold walls include a base mold wall and at least one side mold wall, the at least one projection being spaced a distance from the at least one side mold wall.

15. The beverage cooling system of claim 11, wherein the at least one projection is at least partially defined by a side mold wall of the ice mold.

16. The beverage cooling system of claim 11, wherein the sink is configured such that as the block of ice melts into a liquid phase, the liquid phase is removable from the sink.

* * * * *